US007330159B2

(12) United States Patent
Yao et al.

(10) Patent No.: US 7,330,159 B2
(45) Date of Patent: Feb. 12, 2008

(54) ASSEMBLY FOR A WIRELESS ELECTRONIC DEVICE

(75) Inventors: Ko-Yi Yao, Tao-Yuan Hsien (TW); Sung-Chin Wei, Taipei Hsien (TW)

(73) Assignee: Mitac International Corp., Tao-Yuan Hsien (TW)

( * ) Notice: Subject to any disclaimer, the term of this patent is extended or adjusted under 35 U.S.C. 154(b) by 171 days.

(21) Appl. No.: 11/224,208

(22) Filed: Sep. 12, 2005

(65) Prior Publication Data

US 2006/0176228 A1 Aug. 10, 2006

(30) Foreign Application Priority Data

Feb. 4, 2005 (TW) ..... 94103635 A

(51) Int. Cl.
*H01Q 1/42* (2006.01)

(52) U.S. Cl. ..... 343/872

(58) Field of Classification Search ..... 343/872, 343/713, 878

See application file for complete search history.

(56) References Cited

U.S. PATENT DOCUMENTS

| | | | | |
|---|---|---|---|---|
| 5,081,467 | A * | 1/1992 | Homer | 343/795 |
| 6,750,823 | B2 * | 6/2004 | Turnbull et al. | 343/713 |
| 6,788,256 | B2 * | 9/2004 | Hollister | 343/700 MS |
| 6,894,659 | B2 * | 5/2005 | Pepperling et al. | 343/878 |
| 7,023,379 | B2 * | 4/2006 | Turnbull | 342/357.1 |
| 7,161,554 | B2 * | 1/2007 | Nugnes et al. | 343/878 |

* cited by examiner

*Primary Examiner*—Huedung Mancuso
(74) *Attorney, Agent, or Firm*—Trop, Pruner & Hu, P.C.

(57) ABSTRACT

An assembly for a wireless electronic device includes a support and an antenna module. The wireless electronic module includes a casing, and an electronic module mounted in the casing. The support is adapted to support the casing and includes a hollow part. The antenna module is disposed in the hollow part of the support and is coupled to the electronic module.

13 Claims, 4 Drawing Sheets

ASSEMBLY FOR A WIRELESS ELECTRONIC DEVICE

CROSS-REFERENCE TO RELATED APPLICATION

This application claims priority of Taiwanese application no. 094103635, filed on Feb. 4, 2005.

BACKGROUND OF THE INVENTION

1. Field of the Invention

The invention relates to an assembly for a wireless electronic device.

2. Description of the Related Art

FIG. 1 illustrates a conventional wireless electronic device 1, such as a global positioning system (GPS) receiver, that includes a casing 11, an electronic module (not shown), a support 12, and an antenna module 13. The electronic module is mounted in the casing 11. The support 12 has a first part that is mounted to a wall 4, such as a windshield of an automobile, and a second part that is connected to the casing 11. The antenna module 13 has a contact end that extends into the casing 11 and that is coupled to the electronic module.

The aforementioned conventional wireless electronic device 1 is disadvantageous in that antenna is unable to properly receive a signal when obstructed, such as by a building.

SUMMARY OF THE INVENTION

Therefore, the object of the present invention is to provide an assembly for a wireless electronic device that is capable of overcoming the aforesaid drawback of the prior art.

According to one aspect of the present invention, an assembly for a wireless electronic device comprises a support and an antenna module. The wireless electronic device includes a casing, and an electronic module mounted in the casing. The support is adapted to support the casing and includes a hollow part. The antenna module is disposed in the hollow part of the support and is coupled to the electronic module.

According to another aspect of the present invention, a wireless electronic device comprises a casing, an electronic module, and an assembly. The electronic module is mounted in the casing. The assembly includes a support and an antenna module. The support serves to support the casing, and includes a hollow part. The antenna module is disposed in said hollow part of the support and is coupled to the electronic module.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
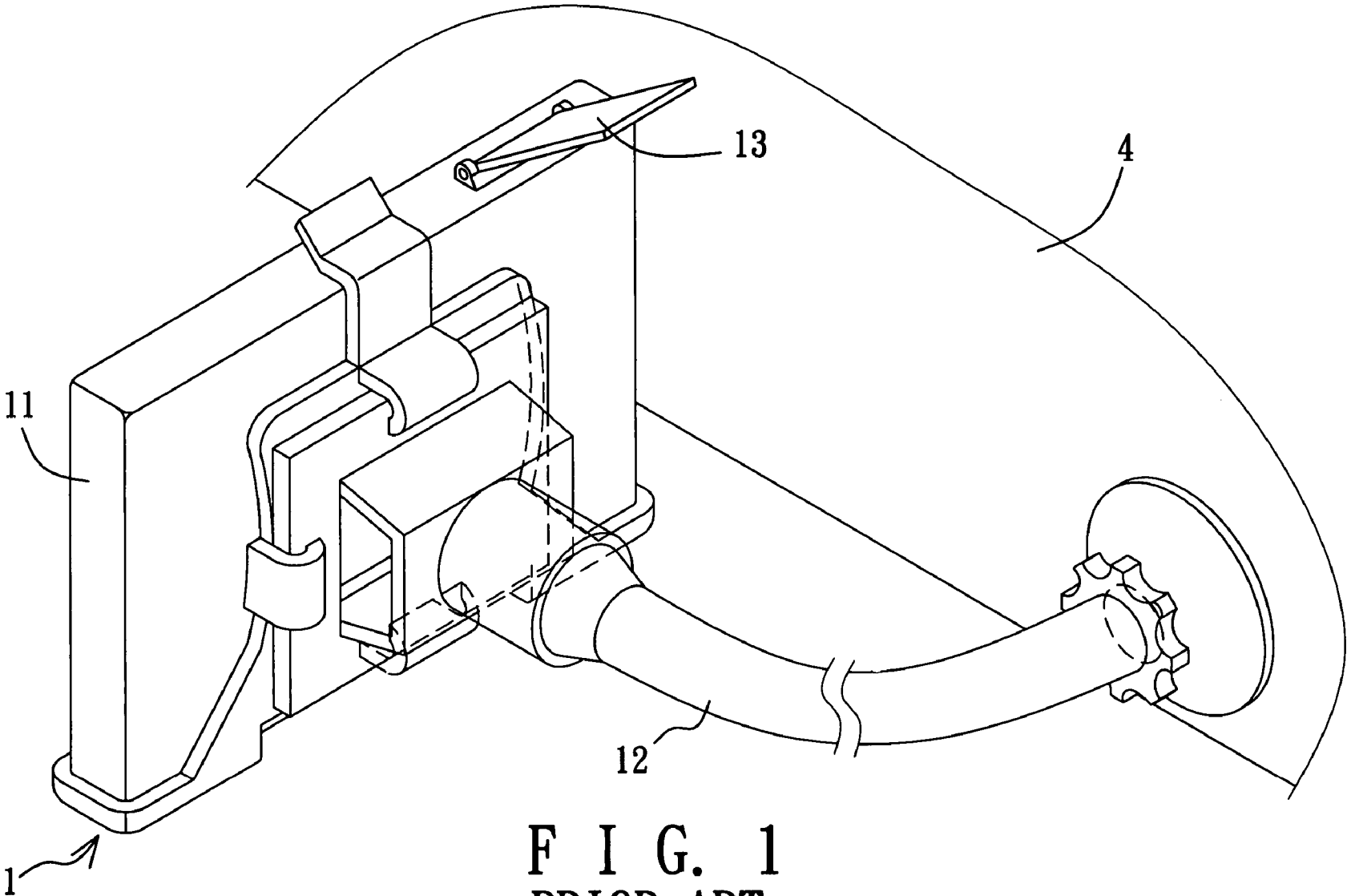
FIG. 1 PRIOR ART
FIG. 1 is a perspective view of a conventional wireless electronic device.

Before the present invention is described in greater detail, it should be noted that like elements are denoted by the same reference numerals throughout the disclosure.

Figure 2:
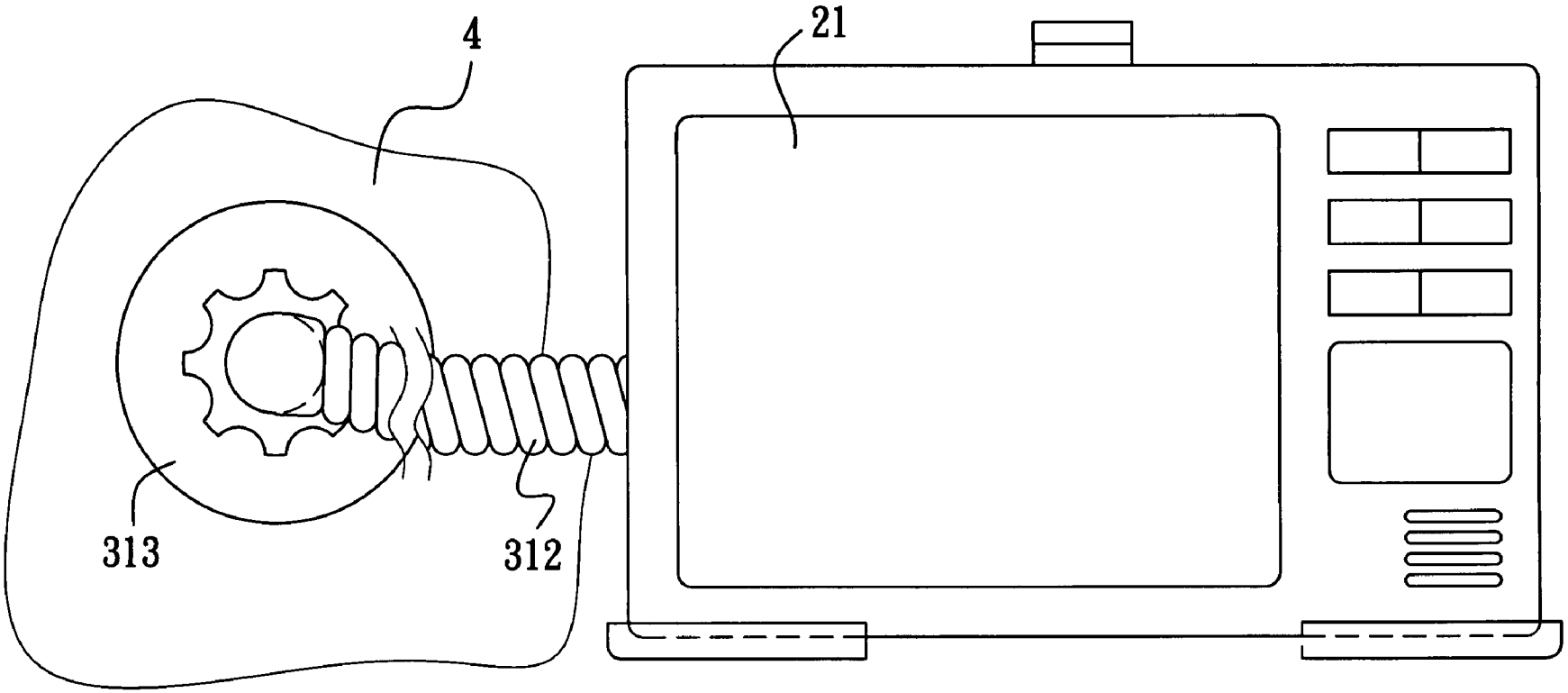
FIG. 2 is a schematic front view of the first preferred embodiment of an assembly according to the present invention.
Figure 3:
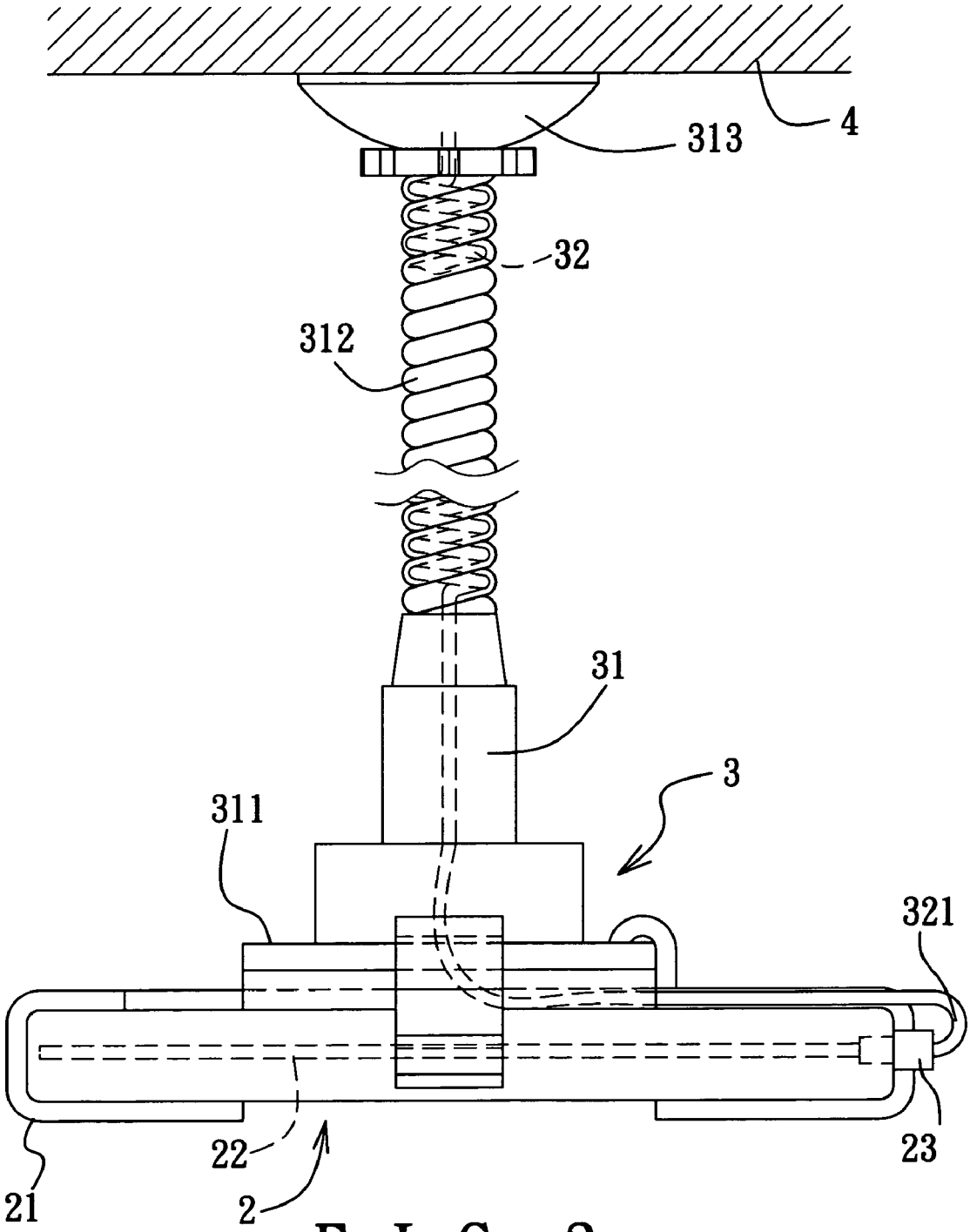
FIG. 3 is a schematic side view of the first preferred embodiment.

Referring to FIGS. 2 and 3, the first preferred embodiment of an assembly 3 according to this invention is shown to include a support 31 and an antenna module 32.

The assembly 3 of this embodiment is applied to a wireless electronic device 2, such as a global positioning system (GPS) receiver. The wireless electronic device 2 includes a casing 21, and an electronic module 22 mounted in the casing 21.

The support 31 includes a mounting part 313 mounted on a wall 4, such as a windshield of an automobile, a connecting part 311 connected to the casing 21 of the wireless electronic device 2, and a hollow part 312 that interconnects the mounting and connecting parts 313, 311 of the support 31. In this embodiment, the mounting part 313 of the support 31 includes a suction cup that is attached removably to the wall 4. Moreover, the hollow part 312 of the support 31 is pliable and has a spiral shape. The construction as such permits adjustment of the orientation of the wireless electronic device 2.

The antenna module 32 is disposed in the hollow part 312 of the support 31 such that the antenna module 32 conforms to the shape of the latter. The construction as such enhances signal reception of the antenna.

It is noted that, in this embodiment, the wireless electronic device 2 further includes an antenna connector 23 that is mounted on the casing 21 of the wireless electronic device 2 and that is coupled to the electronic module 22 of the wireless electronic device 2. The antenna module 32 has a contact end 321 connected electrically and removably to the antenna connector 23, thereby connecting electrically the antenna module 32 to the electronic module 22 of the wireless electronic device 2.

Figure 4:
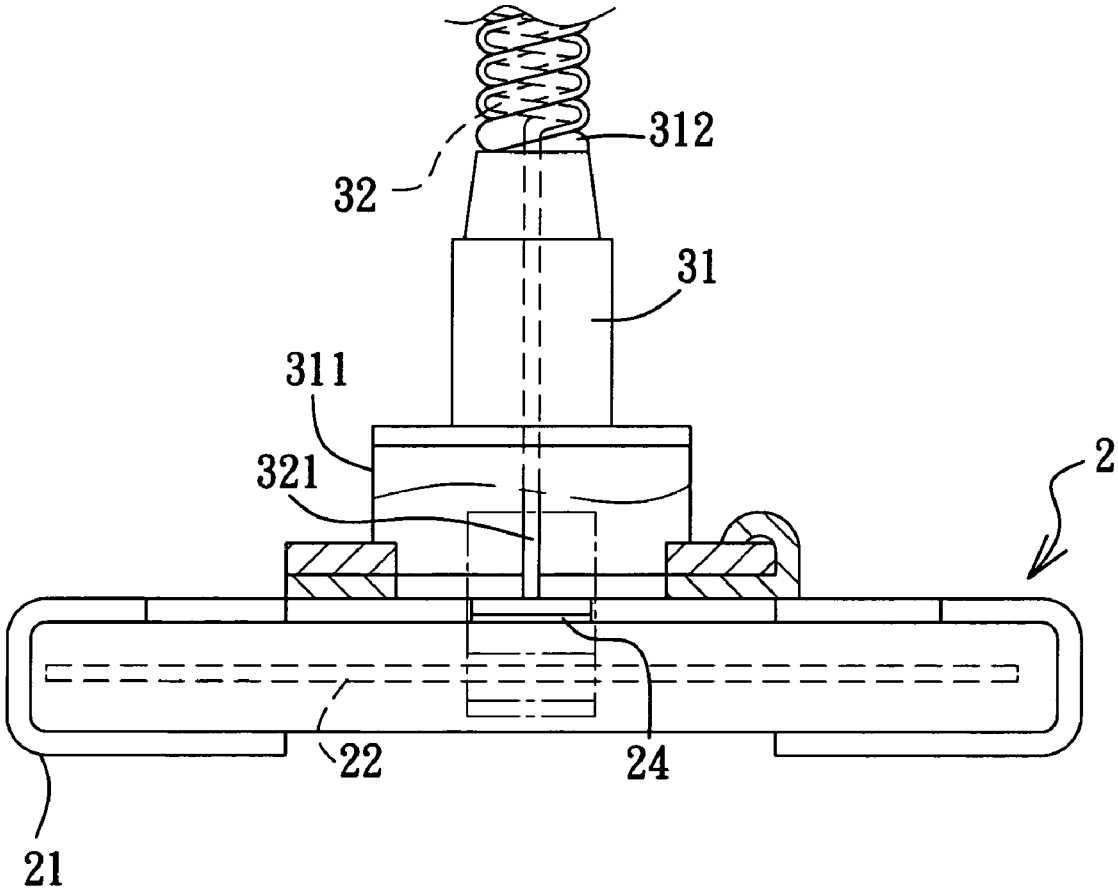
FIG. 4 is a partly sectional view of the second preferred embodiment of an assembly according to the present invention.

FIG. 4 illustrates the second preferred embodiment of an assembly 3 according to the present invention. When compared with the previous embodiment, the antenna connector 23 of the wireless electronic device 2 is dispensed with. Instead, the wireless electronic device 2 includes a metallic plate 24 coupled to the electronic module 22 of the wireless electronic device 2. The casing 21 of the wireless electronic device 2 is formed with a hole that is registered with the metallic plate 24 of the wireless electronic device 2. The contact end 321 of the antenna module 32 extends through the hole and is in contact with the metallic plate 24 of the wireless electronic device 2.

While the present invention has been described in connection with what is considered the most practical and preferred embodiments it is understood that this invention is not limited to the disclosed embodiments but is intended to cover various arrangements included within the spirit and scope of the broadest interpretation so as to encompass all such modifications and equivalent arrangements.

What is claimed is:

1. An assembly for a wireless electronic device, the wireless electronic device including a casing, and an electronic module mounted in the casing, said assembly comprising:

a support adapted to support the casing of the wireless electronic device, and including a hollow part having a spiral shape; and an antenna module disposed in said hollow part of said support, and adapted to be coupled to the electronic module of the wireless electronic device, said antenna module conforms to the spiral shape of the hollow part of the support.

2. The assembly as claimed in claim 1, wherein said support further includes a mounting part adapted to be mounted on a wall, and a connecting part adapted to be connected to the casing of the wireless electronic device, said hollow part of said support interconnecting said mounting and connecting parts of said support.

3. The assembly as claimed in claim 1, wherein said hollow part of said support is pliable.

4. A wireless electronic device, comprising:

a casing;

an electronic module mounted in said casing; and an assembly including a support for supporting said casing, said support including a hollow part having a spiral shape, and an antenna module disposed in said hollow part of said support, said antenna module having a shape that conforms to the shape of the hollow part of the support, and coupled to said electronic module.

5. The wireless electronic device as claimed in claim 4, wherein said support further includes a mounting part adapted to be mounted on a wall, and a connecting part connected to said casing, said hollow part of said support interconnecting said mounting and connecting parts of said support.

6. The wireless electronic device as claimed in claim 5, wherein said hollow part of said support is pliable.

7. The wireless electronic device as claimed in claim 4, further comprising an antenna connector that is mounted on said casing and that is coupled to said electronic module, said antenna module having a contact end that is connected electrically and removably to said antenna connector.

8. The wireless electronic device as claimed in claim 6, further comprising a metallic plate coupled to said electronic module, said casing being formed with a hole registered with said metallic plate, said antenna module having a contact end that extends through said hole in said casing and that is in contact with said metallic plate.

9. A wireless electronic device, comprising:

a casing;

an electronic module mounted in said casing; and an assembly including a support for supporting said casing, said support including a hollow part, an antenna module disposed in said hollow part of said support and coupled to said electronic module; and a metallic plate coupled to said electronic module, wherein said casing is formed with a hole registered with said metallic plate and wherein said antenna module has a contact end that extends through said hole in said casing and that is in contact with said metallic plate.

10. The wireless electronic device as claimed in claim 9, wherein said support further includes a mounting part adapted to be mounted on a wall, and a connecting part connected to said casing, said hollow part of said support interconnecting said mounting and connecting parts of said support.

11. The wireless electronic device as claimed in claim 10, wherein said hollow part of said support is pliable.

12. The wireless electronic device as claimed in claim 11, wherein said hollow part of said support has a spiral shape.

13. The wireless electronic device as claimed in claim 9, further comprising an antenna connector that is mounted on said casing and that is coupled to said electronic module, said antenna module having a contact end that is connected electrically and removably to said antenna connector.

* * * * *